US011364610B2

(12) United States Patent
Lenart

(10) Patent No.: US 11,364,610 B2
(45) Date of Patent: Jun. 21, 2022

(54) PLANK AND TILE LIFTING ASSEMBLY

(71) Applicant: Edward Lenart, Farmington Hills, MI (US)

(72) Inventor: Edward Lenart, Farmington Hills, MI (US)

( * ) Notice: Subject to any disclaimer, the term of this patent is extended or adjusted under 35 U.S.C. 154(b) by 204 days.

(21) Appl. No.: 16/903,540

(22) Filed: Jun. 17, 2020

(65) Prior Publication Data

US 2021/0394348 A1 Dec. 23, 2021

(51) Int. Cl.
*B25C 11/00* (2006.01)

(52) U.S. Cl.
CPC ..... *B25C 11/00* (2013.01)

(58) Field of Classification Search
CPC ..... B25C 11/00; B66F 15/00
See application file for complete search history.

(56) References Cited

U.S. PATENT DOCUMENTS 11,142,921 B2 * 10/2021 Hile ..... B26D 7/18

* cited by examiner

*Primary Examiner* — Nirvana Deonauth

(57) ABSTRACT

A plank and tile lifting assembly includes a plate that has a lower end and a pair of legs is attached to the lower end such that the legs extend forward of the plate. The legs are spaced from each other. A pair of biasing ridges is attached to the rear side of the plate and extends to and beyond a juncture of the plate and the legs. The biasing ridges each have an outer surface that are convexly arcuate to facilitate a lever action of the legs being lifted upwardly as the plate is tilted rearwardly. A panel is attached to the lower end of the plate and has an opposite free edge. The panel extends downwardly from the lower end a distance less than the biasing ridges extend downwardly from the free edge. A handle is attached to the plate.

18 Claims, 10 Drawing Sheets

PLANK AND TILE LIFTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to plank lifting device and more particularly pertains to a new plank lifting device having a unique structure allowing for the removal of planks either utilizing an adjacent plank or a joist.

(2) Description of Related Art Including Information Disclosed Under 37 CFR 1.97 and 1.98

The prior art relates to plank lifting devices that typically include wrecking bar type structure having a rounded heel with a terminal end which forms a chiseled edge and may include a notch for engaging and removing nails. Such devices do not provide enough leverage to prevent planks, such as flooring panels or deck planking, from splitting and are limited in their usefulness once some of the planks have been removed.

BRIEF SUMMARY OF THE INVENTION

An embodiment of the disclosure meets the needs presented above by generally comprising a plate that has a front side, a rear side, an upper end, a lower end, a first lateral edge and a second lateral edge. A pair of legs is attached to the lower end such that the legs extend forward of the plate. The legs are spaced from each other and one of the legs extends downwardly from the first lateral edge and one of the legs extends downwardly from the second lateral edge. Each of the legs has a distal end with respect to the plate. A pair of biasing ridges is attached to the rear side of the plate and extends to and beyond a juncture of the plate and the legs such that each of the legs has a downwardly extending one of the biasing ridges. The biasing ridges each have an outer surface extending away from the plate and an associated one of the legs. The outer surfaces at the junctures are convexly arcuate to facilitate a lever action of the distal ends being lifted upwardly as the plate is tilted rearwardly. A panel is attached to and extends downwardly from the lower end of the plate. The panel is positioned between the legs and has a free edge positioned distal to the lower end. The panel extends downwardly from the lower end a distance less than the biasing ridges extend downwardly from the free edge when the plate is vertically oriented. The plate engages a handle such that the handle extends upwardly from the upper end.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
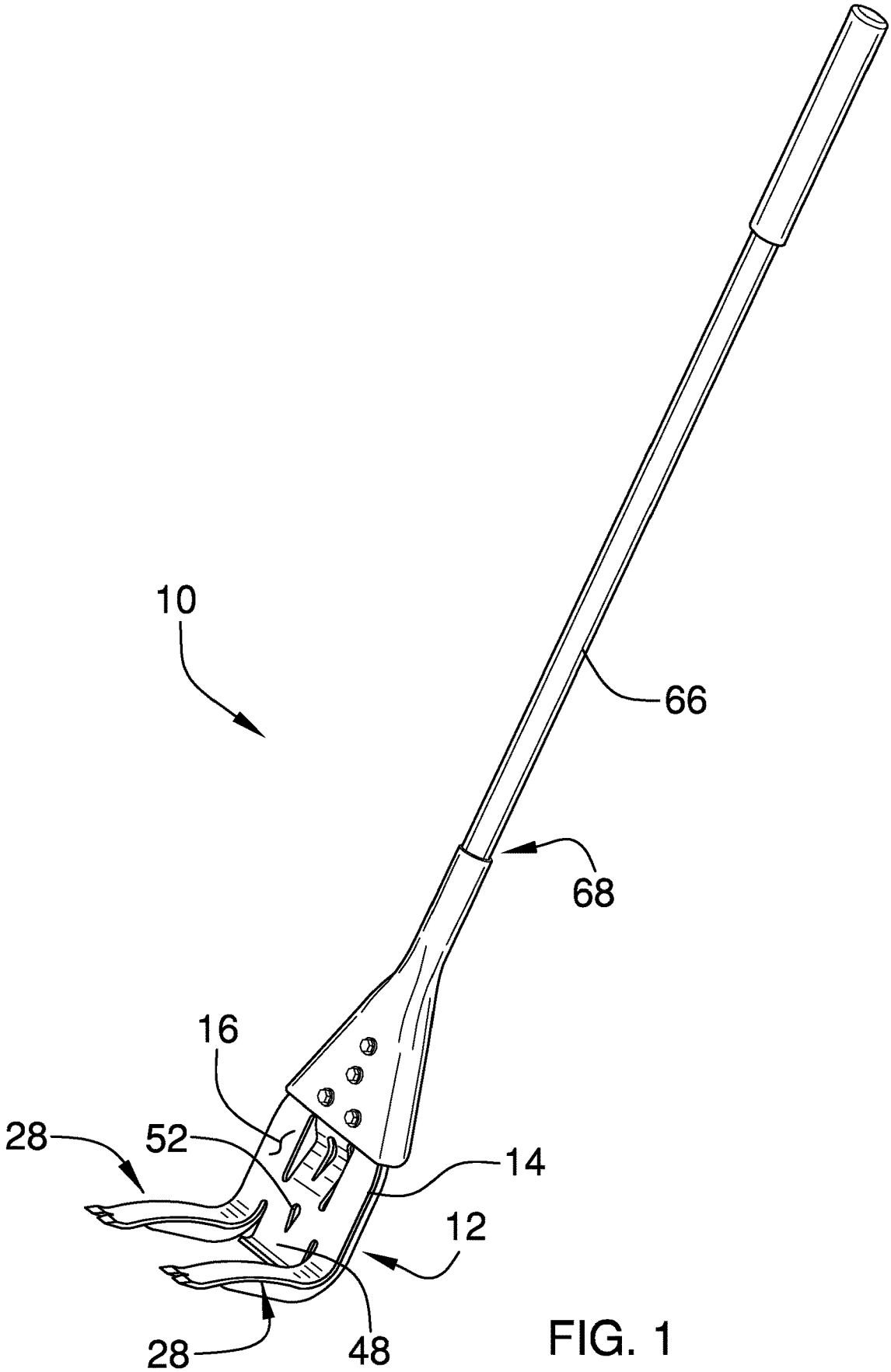
FIG. 1 is a front isometric view of a plank and tile lifting assembly according to an embodiment of the disclosure.
Figure 2:
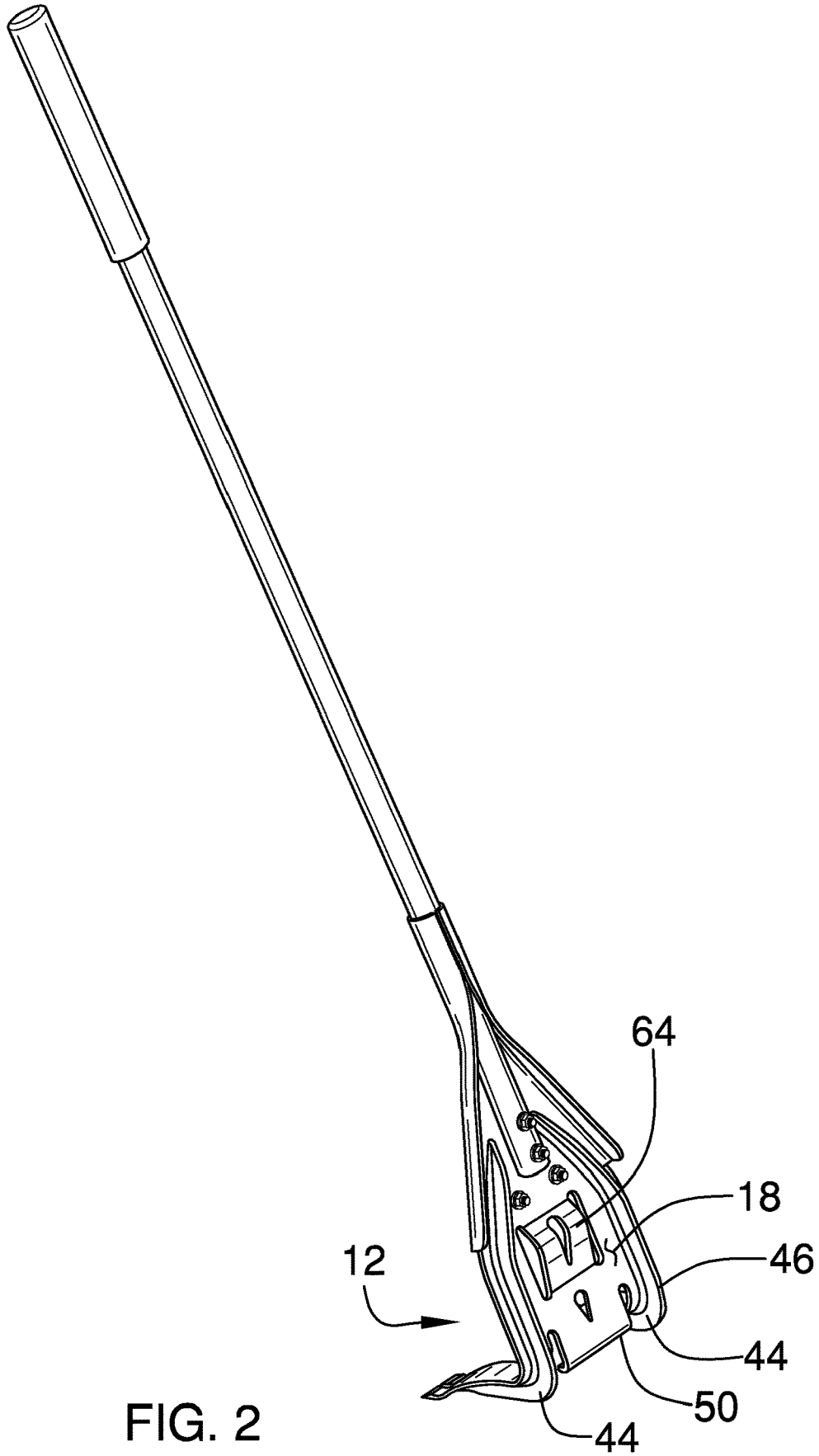
FIG. 2 is a rear isometric view of an embodiment of the disclosure.
Figure 3:
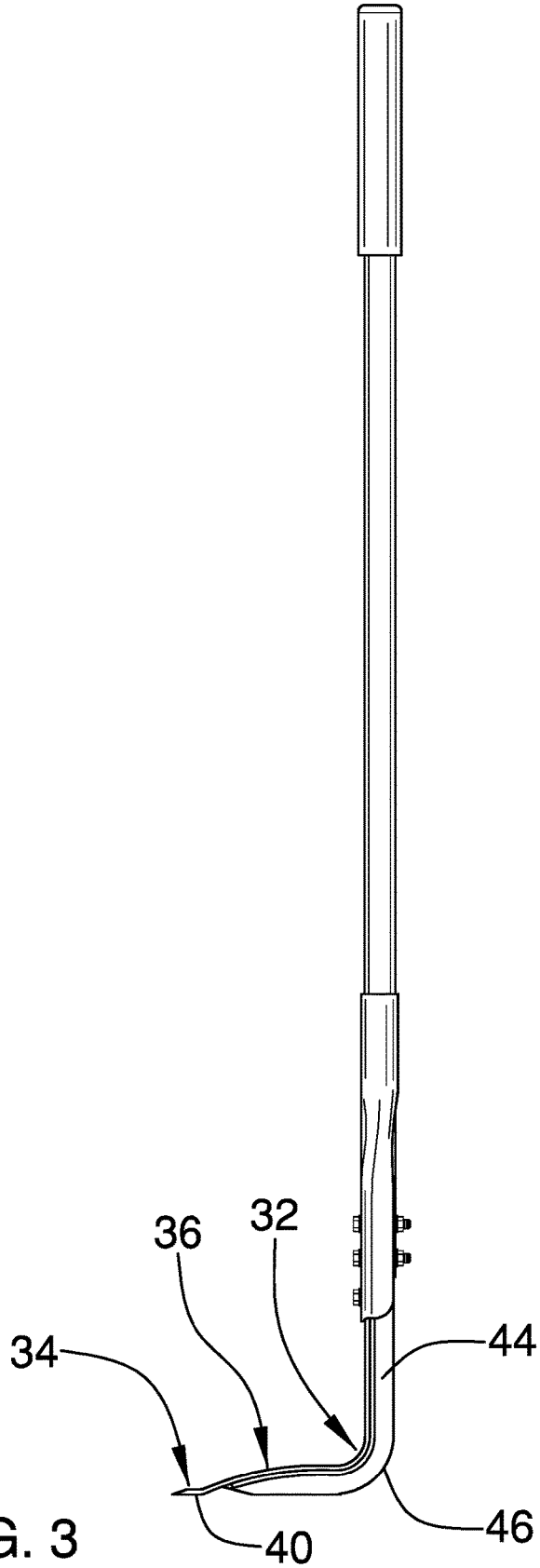
FIG. 3 is a side view of an embodiment of the disclosure.
Figure 4:
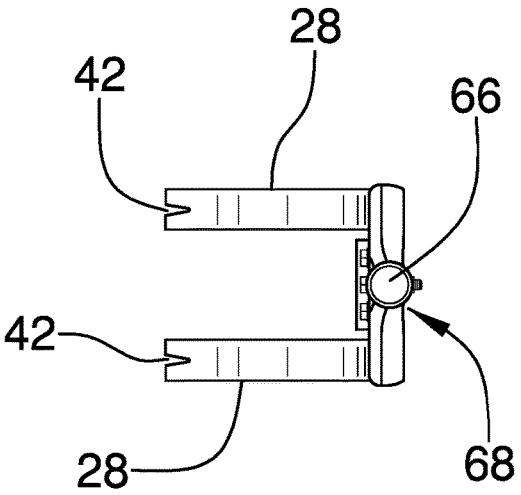
FIG. 4 is a top view of an embodiment of the disclosure.
Figure 5:
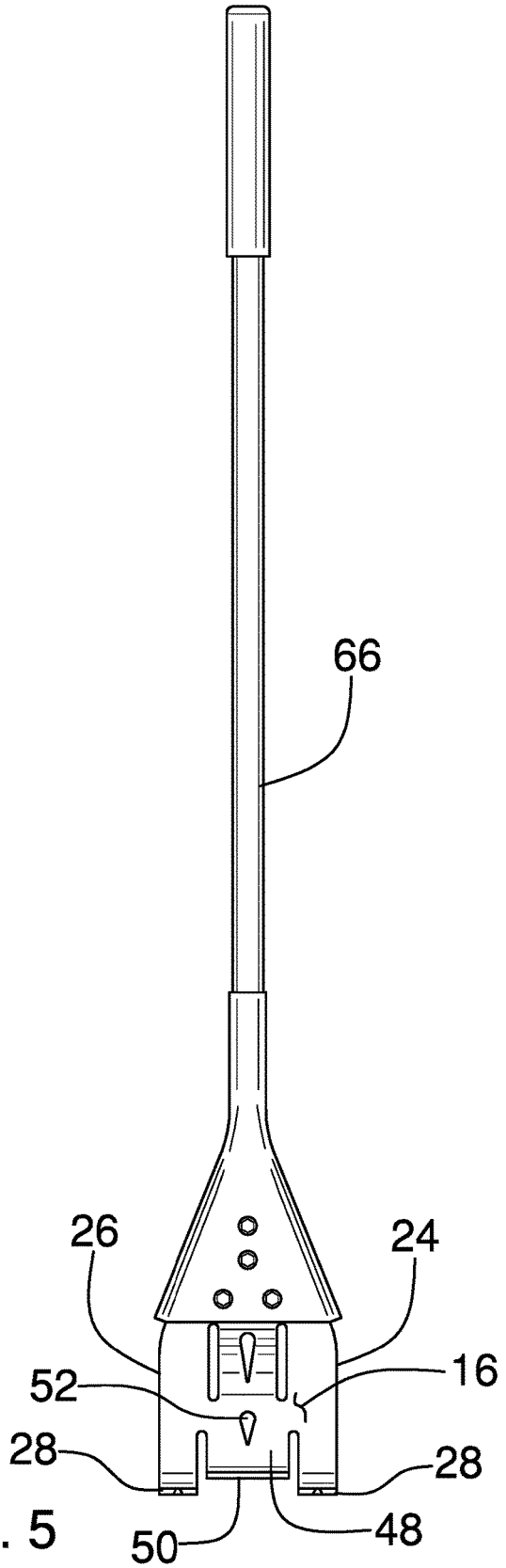
FIG. 5 is a front view of an embodiment of the disclosure.
Figure 6:
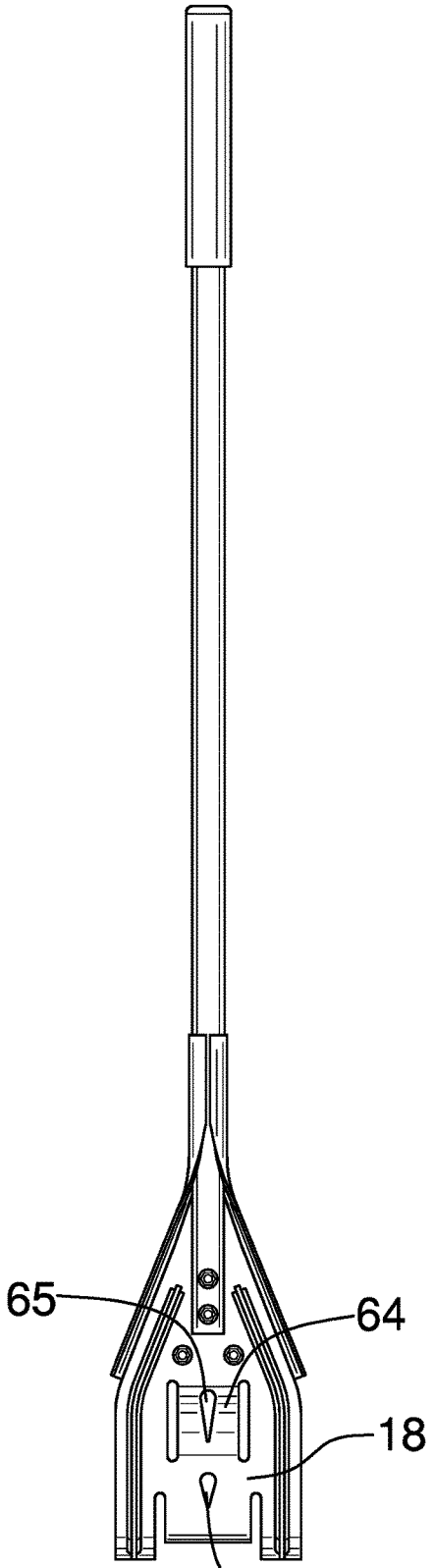
FIG. 6 is a rear view of an embodiment of the disclosure.
Figure 7:
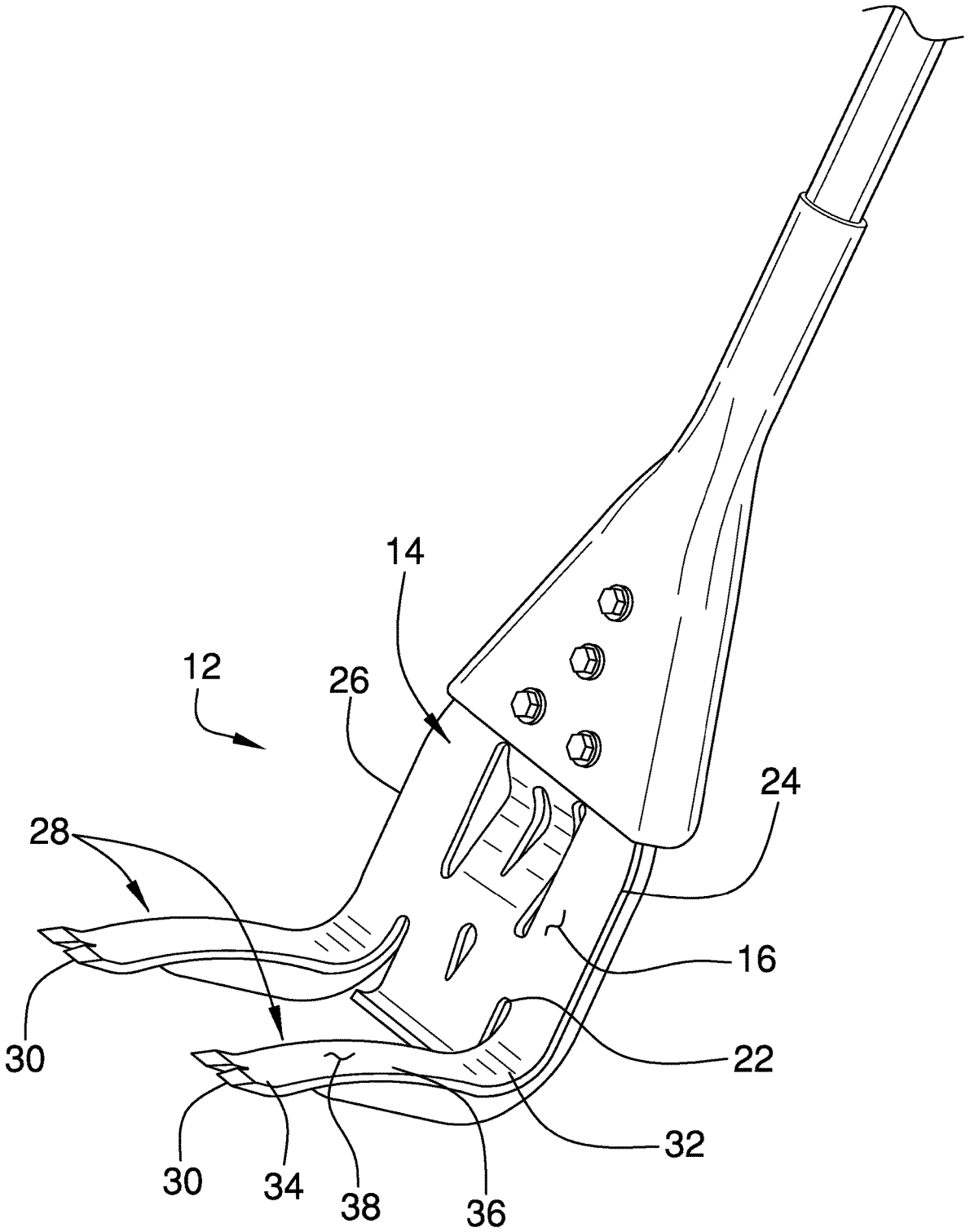
FIG. 7 is a front isometric view of an embodiment of the disclosure.

With reference now to the drawings, and in particular to FIGS. 1 through 13 thereof, a new plank lifting device embodying the principles and concepts of an embodiment of the disclosure and generally designated by the reference numeral 10 will be described.

As best illustrated in FIGS. 1 through 13, the plank and tile lifting assembly 10 generally comprises a head 12 of a tool. As shown best in FIGS. 7 and 8, the head 12 includes a plate 14 that has a front side 16, a rear side 18, an upper end 20, a lower end 22, a first lateral edge 24 and a second lateral edge 26. A pair of legs 28 each is attached to the lower end 22 such that the legs 28 extend forward of the plate 14. The legs 28 are spaced from each other wherein one of the legs 28 extends downwardly from the first lateral edge 24 and one of the legs 28 extends downwardly from the second lateral edge 26. Each of the legs 28 has a distal end 30 with respect to the plate 14. Generally, the legs 28 extend forward of the plate 14 and can be wedged between two attached items, such as two planks attached to each other.

Each of the legs 28 includes an attached section 32 attached directly to the plate 14 and extends downwardly therefrom. An outer section 34 includes the distal end 30 and an intermediate section 36 is positioned between the attached 32 and outer 34 sections. After the attached section 32 extends downwardly from the plate 14, it then bends such that it extends forwardly of the plate 14. The intermediate section 36 may be angled slightly downwardly from the plate 14 when the plate 14 is vertically oriented as can be seen in the Figures while the outer section 34 may be bent upwardly from the intermediate section 36 such that the outer section 34 extends horizontally away from the plate 14 when the plate 14 is vertically oriented. As can be seen in the Figures, this creates a greater space between a top side 38 of the intermediate section 36 and a horizontal plane compared to the top side 38 of the outer section 34.

The top side 38 of the outer section 34, adjacent to the distal end 30, tapers downwardly toward a bottom side 40 of side of the outer section 34 such that the distal end 30 forms a wedge or chisel. This wedge facilitates the penetration of the distal end 40 between two objects mechanically attached together. The distal end 30 has a notch 42 extending therein configured to engage a nail wherein the notch 42 may be V-shaped. It should be understood that only one of the legs 28 may include the notch 42.

Figure 11:
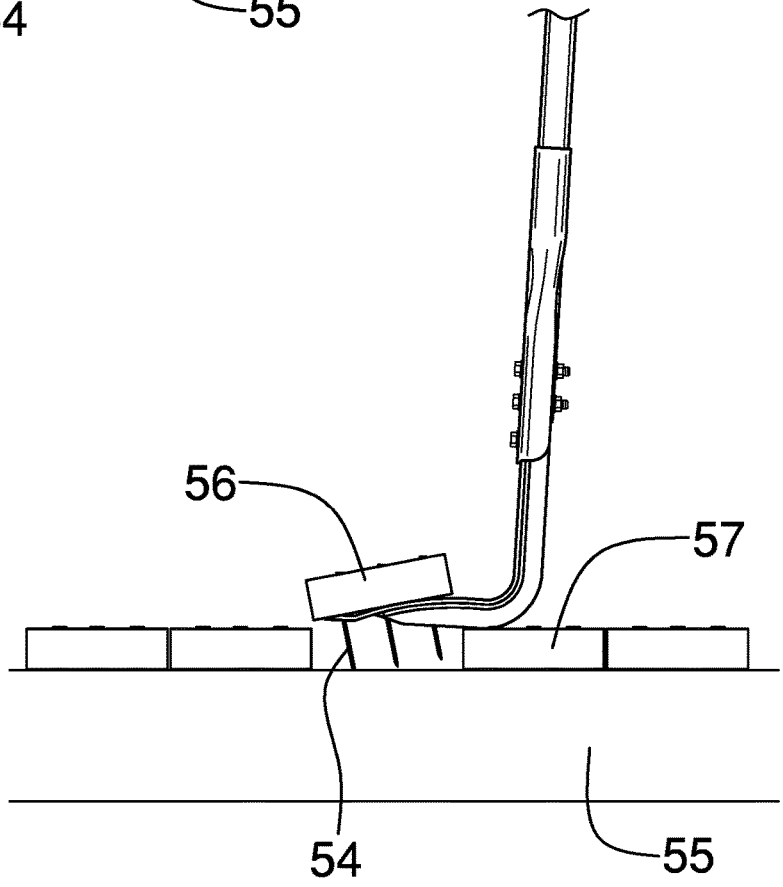
FIG. 11 is a side in-use view of an embodiment of the disclosure.
Figure 12:
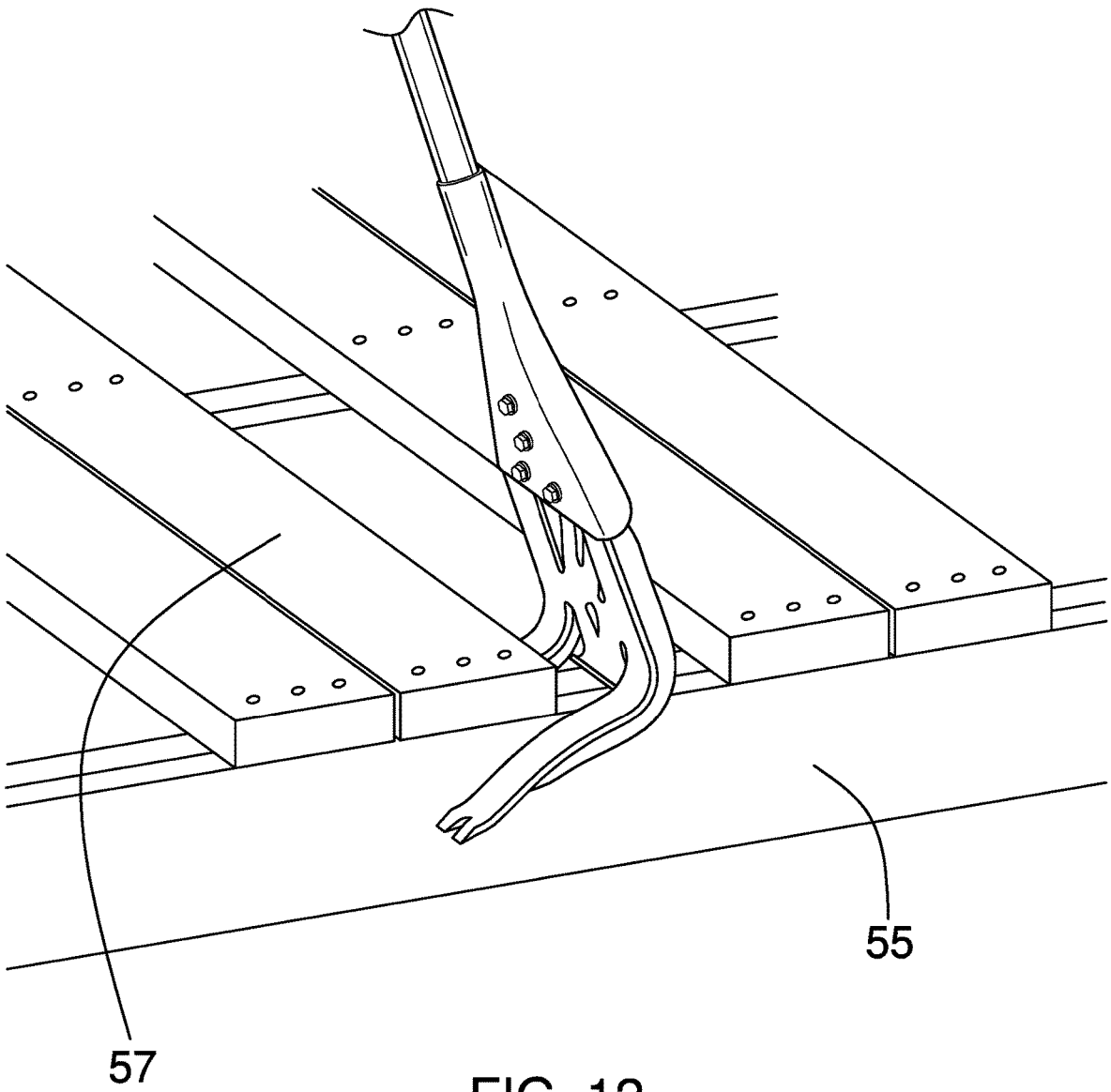
FIG. 12 is a front isometric in-use view of an embodiment of the disclosure.
Figure 13:
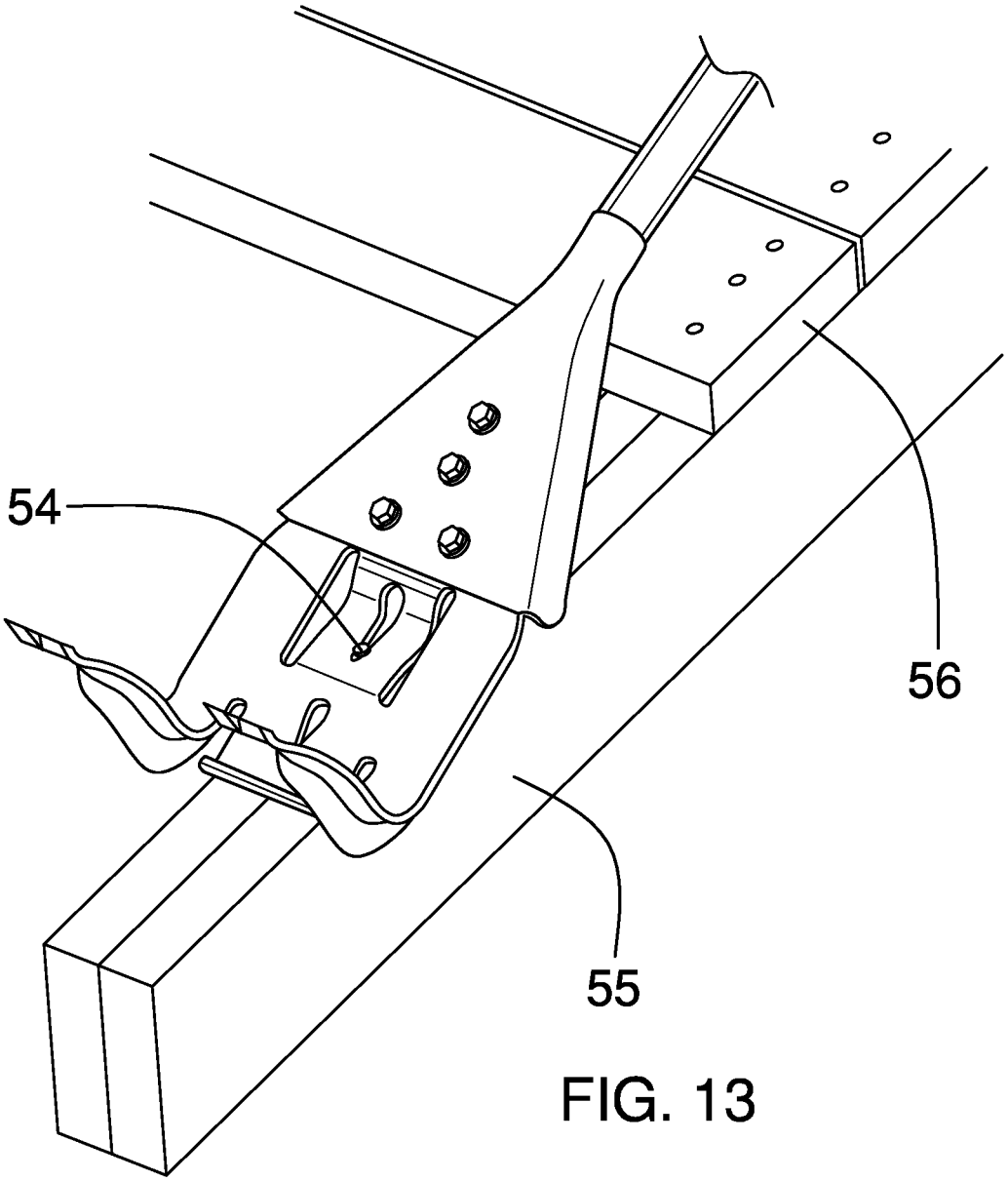
FIG. 13 is a front isometric in-use view of an embodiment of the disclosure.

A pair of biasing ridges 44 is attached to the rear side 18 of the plate 14 and extends to and beyond a juncture of the plate 14 and the legs 28 such that each of the legs 28 has a downwardly extending one of the biasing ridges 44. The biasing ridges 44 each have an outer surface 46 extending away from the plate 14 and an associated one of the legs 28. The outer surfaces 46 at the junctures of the legs 28 and plate 14 are convexly arcuate to facilitate a lever action of the distal ends 30 being lifted upwardly as the plate 14 is tilted rearwardly as is shown in FIG. 11. The biasing ridges 44 may extend along the intermediate sections 36 and are spaced from the distal ends 30. The outer surfaces 46 of the biasing ridges 44 positioned on the intermediate sections 36 are horizontally oriented when the plate 14 is vertically oriented and are aligned with the bottom side 40 of the outer section 34. While the Figures show the biasing ridges 44, it should be understood that the term "ridges" is being used for clarification purposes and it is contemplated that the biasing ridges 44 may be formed from a thickening of the plate 14 along the first 24 and second 26 lateral edges and a thickening of the attached 32 and intermediate 36 sections of the legs 28 such that the biasing ridges 44, plate 14 and legs 28 are of a unitary construction. Therefore, the structure only requires downwardly and rearwardly formed ridges 44 or shoulders that will form a trough between them for reasons that will be better understood below.

A panel 48 is attached to and extends downwardly from the lower end 22 of the plate 14. The panel 48 is positioned between the legs 28 and has a free edge 50 positioned distal to the lower end 22. The panel 48 extends downwardly from the lower end 22 a distance less than the biasing ridges 44 extend downwardly from the free edge 50 when the plate 14 is vertically oriented. That is, a distance from the free edge 50 to the lower end 22 is less than a distance from the outer edges 44 to the lower end 22 measured vertically when the plate is vertically oriented for purposes which will be described below. The panel 48 is curved forwardly adjacent to the free edge 50. The term "curved" is herein used to indicate that a lowermost surface of the free edge 50 is convexly arcuate and therefore may be curved rearwardly as well. This may be achieved by curving the free edge 50 forwardly or, in some instances, rearwardly, but in both cases the curvature allows the free edge 50 to be useful as a leveraging point without its driving into a surface against which it is abutted.

The panel 48 may have an aperture 52 extending therethrough which is used for engaging and pulling nails 54 from planks 56 and other surfaces. The aperture 52 therefore will typically have a pointed end that is directed toward the free edge 50, the aperture is configured to engage a nail. The aperture 52 may extend upwardly beyond the lower end 22 and into the plate 14.

Figure 8:
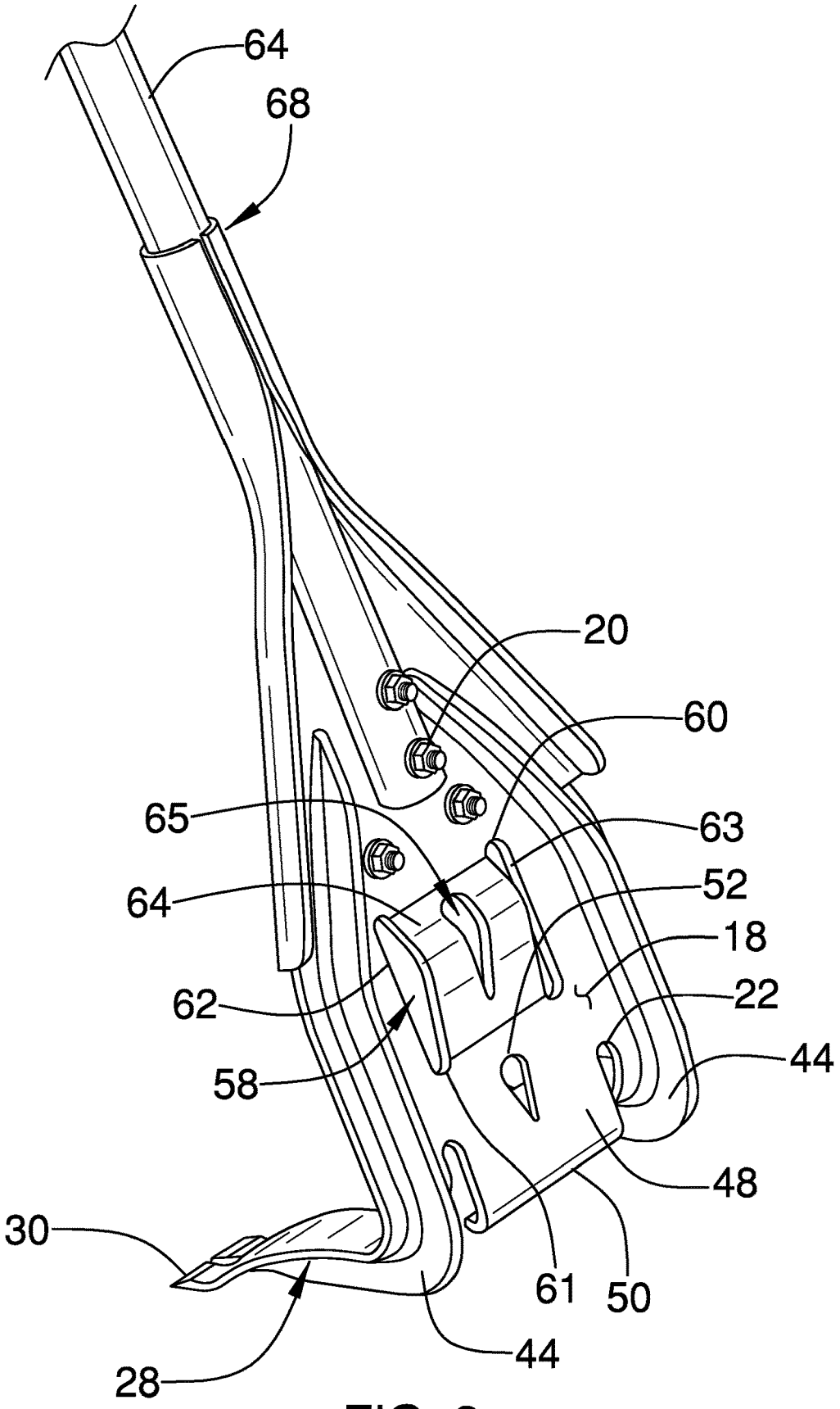
FIG. 8 is a rear isometric view of an embodiment of the disclosure.
Figure 9:
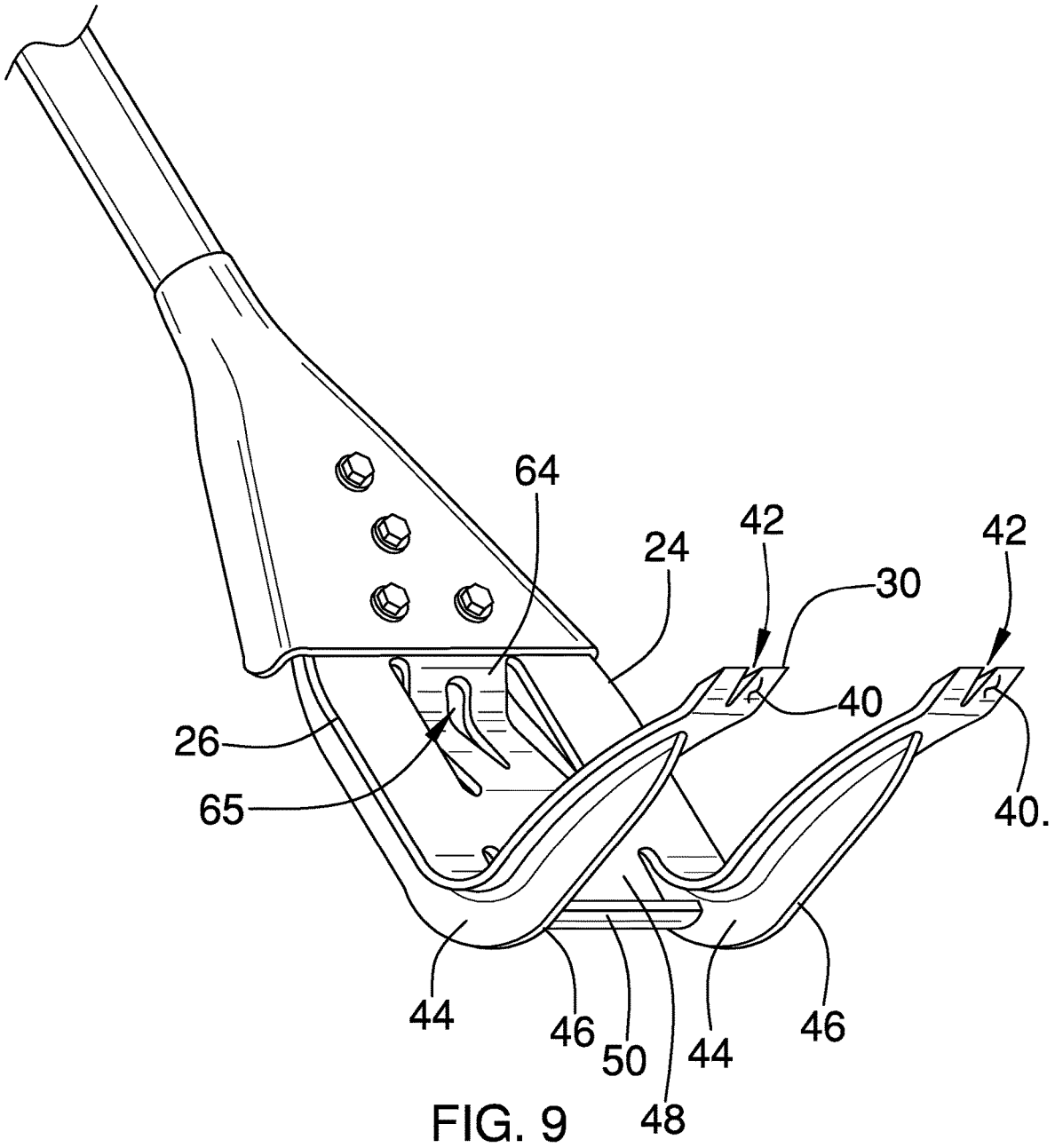
FIG. 9 is a bottom, front isometric view of an embodiment of the disclosure.
Figure 10:
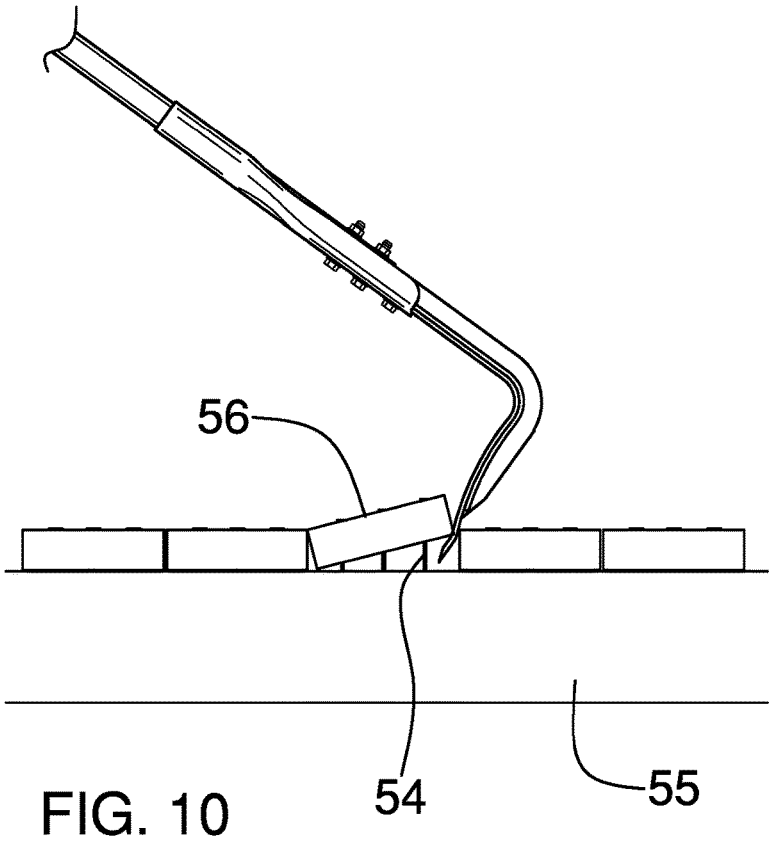
FIG. 10 is a side in-use view of an embodiment of the disclosure.

As shown in FIG. 8, the plate 14 has an orifice 58 extending therethrough positioned between the upper 20 and lower 22 ends. The orifice 58 has a top edge 60, a bottom edge 61, a first side edge 62 and a second side edge 63. A nail pull piece 64 is integrally attached to and extends between the top 60 and bottom 61 edges. The nail pull piece 64 is bowed rearwardly away from the rear side 18 to allow it to reach nails 54 positioned between planks 56, for example. The nail pull piece 64 has an opening 65 extending therethrough and is elongated from the top edge 60 to the bottom edge 61. The opening 65 tapers to a point directed toward the bottom edge 61, and the opening 65 is therefore configured to engage a nail 54 head.

The upper end 20 of the plate 14, or other portions of the plate 14 above the nail pull piece 64, may be configured in a conventional manner to engage a handle 66 such that the handle 66 extends upwardly from the upper end 20. Thus a receiver 68, for example, may be attached to or be integral with the plate 14 and used to engage a handle 66. The handle 66 may be of fixed length or may be telescopic. The length 66 of the handle may vary depending on usage and be less than 12.0 inches but will typically have length greater than 48.0 inches such that the assembly 10 is used while standing.

The head 12 will be comprises of a rigid, metallic material that will typically be a steel alloy. The head 12 may be provided in any required size, however, there will be useful sizes dictated depending on the particular utilization of the head. In one embodiment the head 12 may have dimensions useful for removing planks 56 from wooden pallet, planking from a floor subsurface, ceramic tiles from a floor surface, and tack board from subflooring. In this embodiment, the plate 14 has a height between 5.0 inches and 9.0 inches, and a width from the first lateral edge 24 to the second lateral edge 26 between 4.0 inches and 9.0 inches. The legs 28 extend forwardly from the plate a distance between 5.0 inches and 9.0 inches, while a lowermost surface of the bottom side 40 of the legs 28 or biasing ridges 44 relative to the lower end 22 is vertically spaced from that lowermost surface of the free edge a distance of between 0.40 inches and 1.0 inches. The rearwardly extending surfaces of the biasing ridges 44 extend equal to or more than a distance the prying piece 64 extends rearwardly from the plate 14. Thus, the prying piece 64 and the free edge 50 of the panel 48 are positioned within the trough formed by the biasing ridges 44. Typically the plate 14 will lie in a plane that is oriented perpendicular to a bottom of the biasing ridges 44 positioned on the intermediate sections 36 (i.e. same plane as bottom side of outer sections) but this angle may be larger than 90° and will usually be less than 110°.

In use, the assembly 10 is utilized for the deconstruction of a plurality of constructions and in particular those related to flooring and decking constructions, a number of examples of which will now be explained.

For the removal of a first plank 56 of decking, the distal ends 30 are directed downwardly and between two planks 56, 57. The head 12 is then tilted backwardly such that the distal ends 30 engage the first plank 56 and the legs 28 abut an adjacent plank 57 to lift the distal ends 30 and the first plank 56 upwardly. Once the first plank 56 has cleared the adjacent plank 57, the legs 28 are extended under the first plank 56 and the biasing ridge 44 used on the adjacent plank 57 to completely dislodge the first plank 56 from a joist 55 or subflooring.

In the same example as immediately above, the next plank or the adjacent plank 57 can then be removed using the joist 55 as a pivot base. The legs 28 are extended under the adjacent plank 57 and the free edge 50 abutted against the joist 55. Because the free edge 50 does not extend downwardly away from the plate 14 as far as the legs 28 and biasing ridges 44, the biasing ridges 44 will be positioned on either side of the joist 55 but not engage it. The plate 14 is then tilted rearward and the adjacent plank 57 lifted by engagement of the free edge 50 and the joist 55. Because the biasing ridges 44 are positioned on either side of the joist 55, the biasing ridges 44 serve as a saddle to prevent the head 12 from sliding off of the joist 55.

If any nails 54 remain in the subflooring or joist 55, the notches 42 in the distal edge 30 can be used to engage the nail head and remove it from the joist 55. Alternatively, the free edge 50 may be placed on the joist 55 such that the nail 54 is engaged with the aperture 52 in the panel 48 while the plate 14 is tilted rearward. Once the nail 54 is engaged, the plate 14 is tilted forward to pull the nail 54 upwardly from the joist 55. Finally, the nail 54 may be engaged with the opening 65 in the nail pull piece 64 by rearwardly tilting the plate 14 to such an extent that the opening 65 can receive the nail 54 head. The nail pull piece 65 shape allows for engagement of nails 65 that are effectively "countersunk" between two planks.

For flooring and tile, usually one of the flooring panels (or tiles) is removed by wedging the distal ends 30 under the same. However, adjacent flooring panels are removed thereafter usually by having the legs 28 and biasing ridges 44 lying flat on the subfloor with the plate 14 vertically oriented and the distal ends 30 abutting the flooring panel to be removed. The distal ends 30 can wedged under the flooring panels by kicking or otherwise striking the rear side 18 of the panel 14 such that the distal ends 30 are driven under the flooring panel or tile. Once the distal edges 30 are under the flooring panel, the biasing ridges 44 are used to lift the flooring panel upwardly. Tack strip removal is accomplished in a similar manner.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A head assembly for deconstruction tool configured to facilitate lifting planks and removing nails, said head assembly comprising:

a plate having a front side, a rear side, an upper end, a lower end, a first lateral edge and a second lateral edge;

a pair of legs each being attached to said lower end such that said legs extend forward of said plate, said legs being spaced from each other, wherein one of said legs extends downwardly from said first lateral edge and one of said legs extends downwardly from said second lateral edge, each of said legs having a distal end with respect to said plate;

a pair of biasing ridges being attached to said rear side of said plate and extending to and beyond a juncture of said plate and said legs such that each of said legs has a downwardly extending one of said biasing ridges, said biasing ridges each having an outer surface extending away from said plate and an associated one of said legs, said outer surfaces at said junctures being convexly arcuate to facilitate a lever action of said distal ends being lifted upwardly as said plate is tilted rearwardly;

a panel being attached to and extending downwardly from said lower end of said plate, said panel being positioned between said legs, said panel having a free edge positioned distal to said lower end, said panel extending downwardly from said lower end a distance less than said biasing ridges extend downwardly from said lower end when said plate is vertically oriented; and wherein said plate is configured to engage a handle such that said handle extends upwardly from said upper end.

2. The head assembly according to claim 1, wherein each of said legs includes:

an attached section attached to said plate;

an outer section including said distal end;

an intermediate section positioned between said attached and outer sections, said attached section extending downwardly and then forwardly of said plate, said intermediate section being angled downwardly from said plate and said outer section extending horizontally away from said plate when said plate is vertically oriented.

3. The head assembly according to claim 2, wherein a top side of said outer section of each said leg adjacent to said distal end of each said leg tapers downward toward a bottom side of said outer section of each said leg such that said distal end of each said leg forms a wedge.

4. The head assembly according to claim 3, wherein said distal end of each said leg has a notch extending therein configured to engage a nail.

5. The head assembly according to claim 2, wherein said distal end of each said leg has a notch extending therein configured to engage a nail.

6. The head assembly according to claim 1, wherein said distal end of each of said legs has a notch extending therein configured to engage a nail.

7. The head assembly according to claim 2, wherein said biasing ridges extend along said intermediate sections and are spaced from said distal ends.

8. The head assembly according to claim 7, wherein said outer surfaces of said biasing ridges are positioned on said intermediate sections and are horizontally oriented when said plate is vertically oriented.

9. The head assembly according to claim 1, wherein said panel is curved forwardly adjacent to said free edge.

10. The head assembly according to claim 9, wherein said panel has an aperture extending therethrough, said aperture having a pointed end being directed toward said free edge, said aperture being configured to engage a nail.

11. The head assembly according to claim 1, wherein said panel has an aperture extending therethrough, said aperture having a pointed end being directed toward said free edge, said aperture being configured to engage a nail.

12. The head assembly according to claim 1, wherein said plate has an orifice extending therethrough positioned between said upper and lower ends, said orifice has a top edge, a bottom edge, a first side edge and a second side edge, a nail pull piece being integrally attached to and extending between said top and bottom edges, said nail pull piece being bowed rearwardly away from said rear side.

13. The head assembly according to claim 12, wherein said nail pull piece has an opening extending therethrough and being elongated from said top edge to said bottom edge, said opening tapering to a point directed toward said bottom edge, said opening being configured to engage a nail head.

14. The head assembly according to claim 10, wherein said plate has an orifice extending therethrough positioned between said upper and lower ends, said orifice has a top edge, a bottom edge, a first side edge and a second side edge, a nail pull piece being integrally attached to and extending between said top and bottom edges, said nail pull piece being bowed rearwardly away from said rear side.

15. The head assembly according to claim 14, wherein said nail pull piece has an opening extending therethrough and being elongated from said top edge to said bottom edge, said opening tapering to a point directed toward said bottom edge, said opening being configured to engage a nail head.

16. The head assembly according to claim 4, wherein said plate has an orifice extending therethrough positioned between said upper and lower ends, said orifice has a top edge, a bottom edge, a first side edge and a second side edge, a nail pull piece being integrally attached to and extending between said top and bottom edges, said nail pull piece being bowed rearwardly away from said rear side.

17. The head assembly according to claim 16, wherein said nail pull piece has an opening extending therethrough and being elongated from said top edge to said bottom edge, said opening tapering to a point directed toward said bottom edge, said opening being configured to engage a nail head.

18. A head assembly for deconstruction tool configured to facilitate lifting planks and removing nails, said head assembly comprising:

a plate having a front side, a rear side, an upper end, a lower end, a first lateral edge and a second lateral edge;

a pair of legs each being attached to said lower end such that said legs extend forward of said plate, said legs being spaced from each other, wherein one of said legs extends downwardly from said first lateral edge and one of said legs extends downwardly from said second lateral edge, each of said legs having a distal end with respect to said plate, said legs extending forward of said plate;

each of said legs including:

an attached section attached to said plate;

an outer section including said distal end;

an intermediate section positioned between said attached and outer sections, said attached section extending downwardly and then forwardly of said plate, said intermediate section being angled downwardly from said plate and said outer section extending horizontally away from said plate when said plate is vertically oriented;

a top side of said outer section adjacent to said distal end tapering downward toward a bottom side of side of said outer section such that said distal end forms a wedge;

said distal end having a notch extending therein configured to engage a nail;

a pair of biasing ridges being attached to said rear side of said plate and extending to and beyond a juncture of said plate and said legs such that each of said legs has a downwardly extending one of said biasing ridges, said biasing ridges each having an outer surface extending away from said plate and an associated one of said legs, said outer surfaces at said junctures being convexly arcuate to facilitate a lever action of said distal ends being lifted upwardly as said plate is tilted rearwardly, said biasing ridges extending along said intermediate sections and being spaced from said distal ends, said outer surfaces of said biasing ridges positioned on said intermediate sections being horizontally oriented when said plate is vertically oriented;

a panel being attached to and extending downwardly from said lower end of said plate, said panel being positioned between said legs, said panel having a free edge positioned distal to said lower end, said panel extending downwardly from said lower end a distance less than said biasing ridges extend downwardly from said lower end when said plate is vertically oriented, said panel being curved forwardly adjacent to said free edge;

said panel having an aperture extending therethrough, said aperture having a pointed end being directed toward said free edge, said aperture being configured to engage a nail;

said plate having an orifice extending therethrough positioned between said upper and lower ends, said orifice has a top edge, a bottom edge, a first side edge and a second side edge, a nail pull piece being integrally attached to and extending between said top and bottom edge, said nail pull piece being bowed rearwardly away from said rear side, said nail pull piece having an opening extending therethrough and being elongated from said top edge to said bottom edge, said opening tapering to a point directed toward said bottom edge, said opening being configured to engage a nail head; and wherein said plate is configured to engage a handle such that said handle extends upwardly from said upper end.

* * * * *